US005519414A

United States Patent [19]

Gold et al.

[11] Patent Number: 5,519,414

[45] Date of Patent: May 21, 1996

[54] VIDEO DISPLAY AND DRIVER APPARATUS AND METHOD

[75] Inventors: Robert J. Gold; Dan E. Jennings, both of Austin; Homer L. Webb, Sequin, all of Tex.

[73] Assignee: Off World Laboratories, Inc., Austin, Tex.

[21] Appl. No.: 19,774

[22] Filed: Feb. 19, 1993

[51] Int. Cl.[6] ..... G09G 3/00

[52] U.S. Cl. ..... 345/208; 345/94; 345/99

[58] Field of Search ..... 340/794, 766, 340/752, 773, 774, 776, 783, 784, 795, 758, 787, 825.81, 825.82; 313/505, 584, 309; 345/55, 68, 56, 60, 800, 66, 67, 84, 211, 212, 213, 99, 100, 208, 94; 358/230

[56] References Cited

U.S. PATENT DOCUMENTS

| | | | |
|---|---|---|---|
| 1,863,278 | 6/1932 | Nicolson | 358/230 |
| 1,985,723 | 12/1934 | Gillespie | 358/230 |
| 3,513,258 | 5/1970 | Rackman . | |
| 3,622,829 | 11/1971 | Watanabe | 345/66 |
| 3,716,658 | 2/1973 | Rackman | 345/98 |
| 3,845,241 | 10/1974 | Schwartz | 345/60 |
| 3,956,667 | 5/1976 | Veith | 345/72 |
| 3,975,085 | 8/1976 | Yamada et al. | 340/825.81 |
| 3,987,337 | 10/1976 | Nishida et al. | 345/42 |
| 4,005,402 | 1/1977 | Amano | 345/72 |
| 4,006,298 | 2/1977 | Fowler et al. | 345/147 |
| 4,030,090 | 6/1977 | Endriz | 345/74 |
| 4,078,229 | 3/1978 | Swanson et al. | 340/173 |
| 4,080,597 | 3/1978 | Mayer et al. | 345/66 |
| 4,090,109 | 5/1978 | Ryan et al. | 345/68 |
| 4,142,181 | 2/1979 | Moricca et al. | 348/800 |

(List continued on next page.)

FOREIGN PATENT DOCUMENTS

| | | |
|---|---|---|
| 0154662 | 9/1985 | European Pat. Off. . |
| 1334553 | 7/1963 | France . |
| 2748149 | 5/1979 | Germany . |
| 2149182 | 6/1985 | United Kingdom . |
| 9110340 | 7/1991 | WIPO . |
| 9117537 | 11/1991 | WIPO . |

OTHER PUBLICATIONS

Analog Devices, Digitally Programmable Delay Generator, AD9501, pp. 1–12.

*Primary Examiner*—Richard Hjerpe
*Assistant Examiner*—Lun-Yi Lao
*Attorney, Agent, or Firm*—J. Scott Denko

[57] ABSTRACT

This invention relates to an apparatus and method for creating visual images on a display area. This invention uses the selective convergence of traveling electrical signals to cause selected display locations located across a display area to illuminate or to change their visual appearances. The apparatus of the invention includes a display mechanism that either illuminates or changes its visual appearance when activated, at least one signal propagation path that directs the propagation of the signals across the display area, and signal control equipment for selectively transmitting the signals. In a preferred embodiment first and second signal propagation paths provide unique propagation paths that pass through each of a the display locations across the area of the display. The signal control equipment selectively delays the transmission of the second signal relative to the first signal causing the signals to converge at a selected location to produce a change in the visual appearance of the screen at the selected location. By repeatedly altering the appearance of display locations across the display area, visual images may be produced. Requiring as few as one screen driver, the hardware requirements of the invention are minimal. The present invention also includes a method for producing visual images using the above described apparatus. Further disclosed are apparatus for continuing the display signal once activated and for better directing the electrical signals to produce an activating signal at a selected display location. Further included are apparatus and methods for selectively activating each of the plurality of display locations across the display area using signal trains made up of a plurality of selectively controlled pulses.

9 Claims, 13 Drawing Sheets

U.S. PATENT DOCUMENTS

| | | | |
|---|---|---|---|
| 4,234,821 | 11/1980 | Kako et al. | 345/76 |
| 4,303,917 | 12/1981 | Kishino et al. | 345/75 |
| 4,306,234 | 12/1981 | Mayer | 340/758 |
| 4,322,720 | 3/1982 | Hughes | 340/825.81 |
| 4,338,539 | 7/1982 | Littwin | 313/584 |
| 4,341,976 | 7/1982 | Hanlet | 313/484 |
| 4,406,997 | 9/1983 | Deep et al. | 345/205 |
| 4,450,441 | 5/1984 | Person et al. | 340/773 |
| 4,467,325 | 8/1984 | Lustig | 345/207 |
| 4,531,122 | 7/1985 | Redfield | 345/74 |
| 4,554,537 | 11/1985 | Dick | 345/68 |
| 4,611,203 | 9/1986 | Criscimagna et al. | 345/66 |
| 4,628,228 | 12/1986 | Geffcken et al. | 313/584 |
| 4,636,786 | 1/1987 | Haertling | 340/783 |
| 4,667,130 | 5/1987 | Geffcken | 313/386 |
| 4,686,524 | 8/1987 | White | 340/783 |
| 4,691,145 | 9/1987 | Satoh | 345/75 |
| 4,710,680 | 12/1987 | Nakatani et al. | 359/54 |
| 4,754,203 | 6/1988 | Murakami | 315/169.4 |
| 4,833,464 | 5/1989 | Di Santo et al. | 340/787 |
| 4,896,149 | 1/1990 | Buzak et al. | 340/794 |
| 4,908,609 | 3/1990 | Stroomer | 340/784 |
| 4,935,670 | 6/1990 | Watanabe | 345/75 |
| 4,980,774 | 12/1990 | Brody | 345/205 |
| 4,982,272 | 1/1991 | Brody | 345/205 |
| 4,982,275 | 1/1991 | Brody | 345/205 |
| 5,001,392 | 3/1991 | Lee et al. | 340/773 |
| 5,066,890 | 11/1991 | Salavin et al. | 313/584 |
| 5,068,740 | 11/1991 | Brody | 345/206 |
| 5,079,636 | 1/1992 | Brody | 345/55 |
| 5,086,257 | 2/1992 | Gay et al. | 345/68 |
| 5,107,182 | 4/1992 | Sano et al. | 345/65 |
| 5,131,065 | 7/1992 | Briggs et al. | 345/76 |
| 5,148,079 | 9/1992 | Kado et al. | 313/309 |
| 5,149,918 | 9/1992 | Kozik et al. | 178/18 |
| 5,151,632 | 9/1992 | Troxell | 345/75 |
| 5,202,674 | 4/1993 | Takemori et al. | 345/75 |
| 5,239,227 | 8/1993 | Kikinis | 313/506 |

14
12
20
23
18
22
16
34
36
40
CONTROL CIRCUITRY
DELAY
38

52
50
48

46
44
42

VIDEO DISPLAY AND DRIVER APPARATUS AND METHOD

BACKGROUND OF THE INVENTION

Cathode ray tube video displays have been the standard for many years. Cathode ray tube displays create images by selectively firing of a cathode ray or electron beam on a surface coated with an illuminating material, the surface illuminating in response to the electron beam. With this technology, however, a minimum distance between the source of the electron beam and the surface coated with illuminating material was required in order to properly control the electron beam to produce a desired image. In most cases, the cathode ray was fired substantially perpendicularly to the display screen. Therefore, displays using this technology typically required a minimum distance between the viewing surface of the display screen and the electron gun behind the display screen. Further, the technology has been criticized for emitting potentially damaging amounts of radiation from the cathode ray tube display surface.

In many applications it has been desirable to employ video displays with shorter front to back dimensions. Lap top computers, for example, require thin video displays to create a computer package of a minimal volume. One way to create a thinner video display was to discharge the cathode rays from directions that were not perpendicular to the display screen. However, when cathode rays were fired from these positions, the control of the cathode rays was much more difficult and resulted in the degradation of the video image.

A solution that overcame these problems included selectively energizing specific display locations using an electrical signal. In this arrangement, a display screen was provided with discrete pixels of illuminating material or another material with an alterable appearance. Arranged on the display screens were a plurality of electrically conductive row traces and a plurality of electrically conductive column traces, each row and column trace extending across the screen only once. Typically, the row traces were disposed perpendicularly to the column traces. The pixels were arranged such that energizing a particular row and a particular column caused a specific pixel to illuminate. Therefore, each pixel on the display screen could be uniquely addressed by energizing a certain row and column combination.

This technology, however, required a driver for each row trace and for each column trace. In a system with one thousand rows of resolution and one thousand columns of resolution, 2000 drivers were required. Typically, only one pixel was addressed at a time requiring the individual enablement of a specific row driver and a specific column driver. In operation, an incoming video signal was converted and decoded so that the pixels could be selectively activated. However, with this technology, the required signal decoding and selective enablement of a specific row driver and a specific column driver could not be performed quickly enough to drive high resolution displays. The cost of such displays was great because of the large number of drivers required. Further, these displays were not efficient and, in a typical portable computer installation, consumed a large percentage of the available energy.

SUMMARY OF THE INVENTION

It is therefore a general object of the invention to provide an apparatus and method to overcome the above limitations and others in prior video display devices. More particularly, it is an object of the present invention to provide a thin video display that requires a minimal number of drivers.

A video display driver and screen embodying the principles of the present invention comprises display means, transmission means, and signal control means, the combination of which provides for the selective activation of a plurality of display locations across a display area.

The display means extends throughout the plurality of display locations across the display area and produces a display signal at a selected display location among the plurality of display locations upon receipt of an activating signal at the selected display location. The display means may employ discrete pixels of illuminating material, uniformly distributed illuminating material, gas discharge illumination, liquid crystal display technology, or other means to produce the display signal at the display location.

The transmission means is associated with the display area and provides at least one continuous propagation path extending through each of the plurality of display locations across the display area. The transmission means is for directing the propagation of a first pulsed electrical signal and a second pulsed electrical signal across the display area such that the signals may converge at any of the display locations across the display area.

The signal control means is for selectively transmitting the first and the second pulsed electrical signals along the transmission means such that the first and second pulsed electrical signals converge to produce the activating signal at the selected display location. The propagation velocity of the electrical signals along the transmission means is determined by the physical construction of the transmission means. Thus, each of the signals propagated to a specific display location in a certain respective time. Therefore, by selectively delaying the transmission of the second pulsed electrical signal relative to the first pulsed electrical signal, the signals may be controlled to converge at a selected display location.

In one embodiment of the transmission means, the first pulsed electrical signal propagates along a first trace forming a plurality of substantially parallel rows and providing a continuous propagation path that extends through each of the plurality of display locations. The second pulsed electrical signal propagates along a second trace forming a plurality of substantially parallel rows oriented substantially parallel to and intervolved with the plurality of substantially parallel rows formed by the first trace. The second trace provides a continuous propagation path that also extends through each of the plurality of display locations. The first and second traces are substantially electrically isolated from each other and facilitate the convergence of the first and second pulsed electrical signals at each of the plurality of display locations across the display area.

The transmission means includes a signal propagation delay path connected between the signal control means and the first trace. This delay path provides a signal delay equal to that of the entirety of the second trace which may be calculated by dividing the second trace distance by the second trace propagation speed. Therefore, when the first and second signals are transmitted from the signal control means with zero respective delay, the signals converge to produce the activating signal at a display location corresponding to a an extreme first end of the first trace and an extreme second end of the second trace. By selectively delaying the transmission of the second pulsed electrical signal, the convergence location of the electrical signals may be precisely controlled to cause an illumination at any of the plurality of display locations.

In a minimal configuration only two drivers are required lowering power consumption, software requirements, and hardware requirements. Therefore, the present invention does not suffer from the limitations associated with the prior electrical signal convergence devices. Also, because of the minimal space requirements of the transmission means and display means according to the invention, the display screen may be thinly formed and may be constructed in a one-piece sandwiched manner. The invention further provides for the transmission and convergence of narrow pulses at physically small display locations thus providing high resolution at minimal cost. Alternatively, illuminating material may be uniformly positioned across the area of the display. With this construction, the width of the display location may be varied by varying the widths of the pulsed electrical signals. Thus, the present invention provides for a variable resolution display screen. Further, because the invention does not use cathode ray technology, less radiation is produced by the screen, reducing adverse health effects. Additionally, because the apparatus of this invention may be formed in any shape, a video display created using the principles of this invention need not be substantially flat.

These and other objects, advantages, and features of the invention will be apparent from the following description of the preferred embodiments, considered along with the accompanying drawings.

DESCRIPTION OF THE PREFERRED EMBODIMENTS

Figures 1A, 1B, 1C:
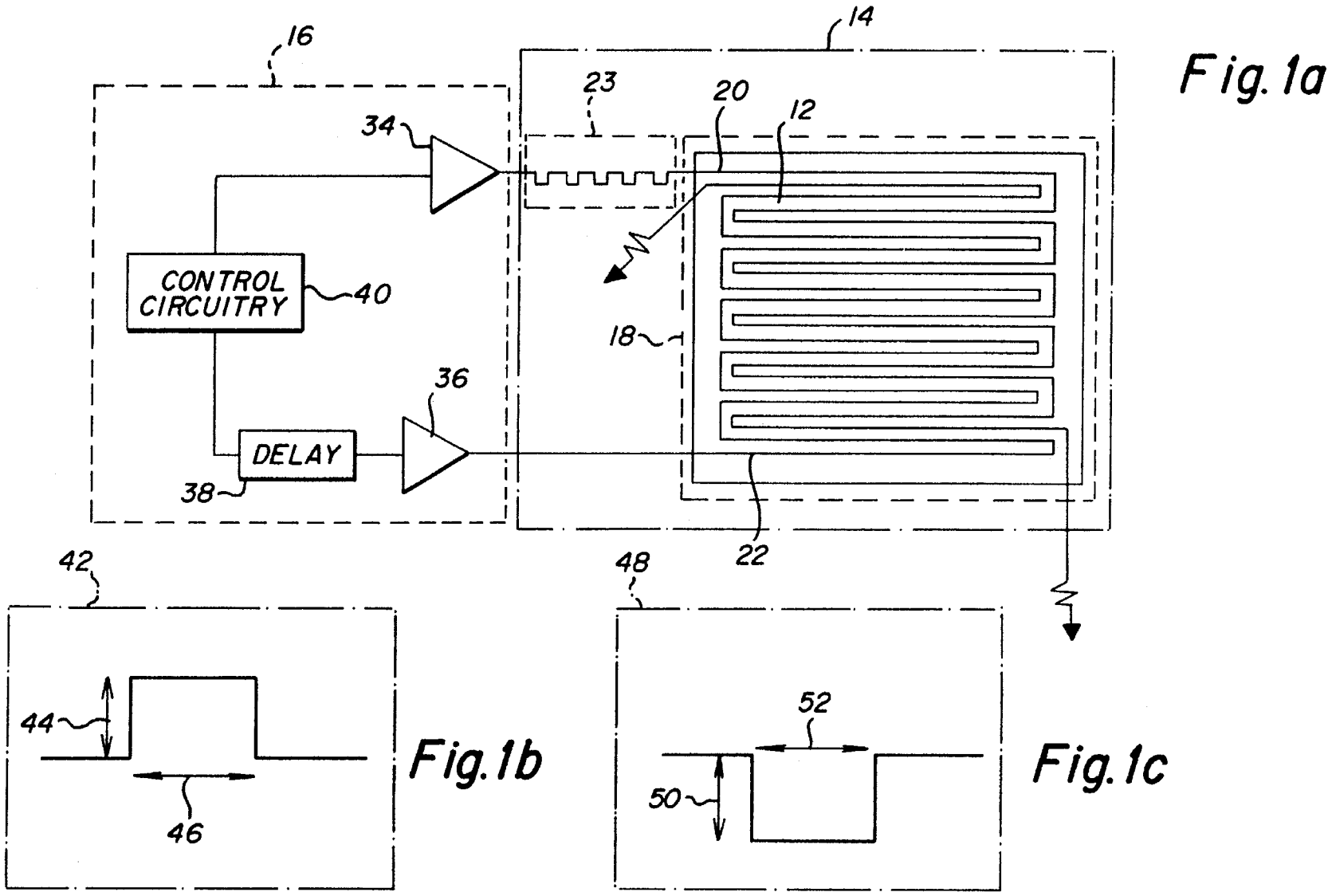
FIG. 1*a* is a diagrammatic view of a video display embodying the principles of the present invention, including a display means, a transmission means, and signal control means.
FIG. 1*b* is a diagrammatic view of a first signal to be transmitted along the transmission means.
FIG. 1*c* is a diagrammatic view of a second signal to be transmitted along the transmission means.

The principles of the present invention are shown by way of illustration in FIGS. 1 through 12. A video display 10 embodying the principles of the present invention is shown in FIG. 1*a* and comprises display means 12, transmission means 14 and signal control means 16.

The display means 12 extends throughout a plurality of display locations across a display area 18. The display means 12 is for producing a display signal at a selected display location among the plurality of display locations upon receipt of an activating signal at the selected display location.

The transmission means 14 is associated with the display area 18 and provides at least one continuous propagation path through each of the plurality of display locations across the display area. The transmission means 14 is for directing the propagation of a first pulsed electrical signal and a second pulsed electrical signal across the display area.

The signal control means 16 is for selectively transmitting the first and second pulsed electrical signals along the transmission means such that the first and second pulsed electrical signals converge to produce the activating signal at the selected display location.

As shown in FIG. 1*a*, the first preferred embodiment of the transmission means 14 includes a first trace 20, a second trace 22, and a signal delay path 23. The first trace 20 forms a plurality of substantially parallel rows and provides a continuous propagation path that extends through each of the plurality of display locations across the display area 18. The second trace 22 forms a plurality of substantially parallel rows oriented substantially parallel to and intervolved with the plurality of substantially parallel rows formed by the first trace 20. The second trace 22 also provides a continuous propagation path that extends through each of the plurality of display locations across the display area 18. The first trace 20 and second trace 22 are substantially electrically isolated from each other and converge at each of the plurality of display locations across the display area 18.

Figure 2:
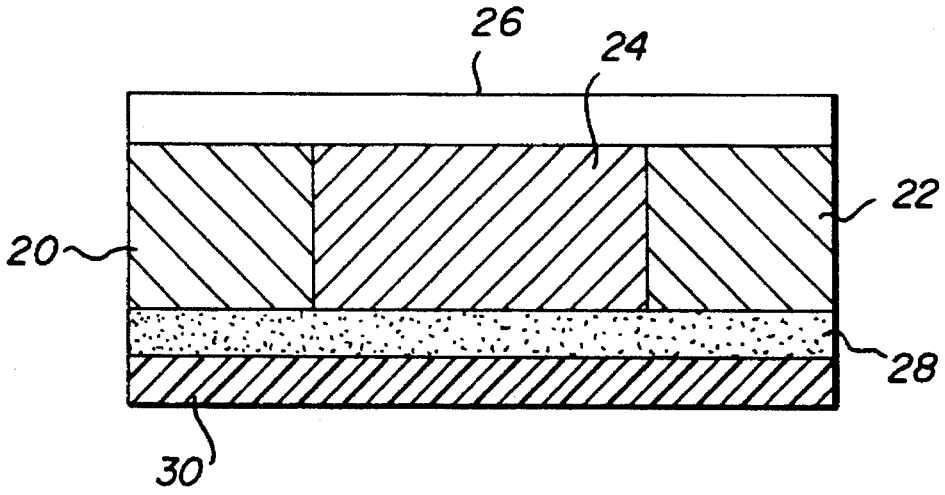
FIG. 2 is a partial sectional diagrammatic view of the first preferred embodiment of the display area of the video display, the view showing how the first preferred embodiment of the transmission means and display means interact.

FIG. 2 shows a partial sectional view of the construction of the display area 18 in a first preferred embodiment. The first preferred embodiment of the display means 12 employs an illuminating material 24 that generates visual light when electrified, a protective cover 26, an insulating substrate layer 28, and a grounded conducting layer 30. The illuminating material 24 is disposed substantially uniformly across the display area 18 as shown in FIG. 2. The area between the first trace 20 and the second trace 22, as shown in this drawing is a display location. When the voltage between the first trace 20 and the second trace 22 becomes large enough, the illuminating material 24 conducts electricity and responsively emits visual light. The grounded conducting layer 30 ensures the uniform propagation of electrical signals along the first trace 20 and the second trace 22. The insulating substrate layer 28 prevents the conduction of electricity from the first trace 20 or the second trace 22 to the grounded conducting layer 30.

Referring again to FIG. 1*a*, the signal control means 16 comprises a first trace driver 34, a second trace driver 36, a signal delay generator 38, and control circuitry 40. Control circuity 40 selectively causes the first trace driver 34 to produce a first pulsed electrical signal 42 of a selected voltage 44 and a selected width 46 as shown in FIG. 1*b*. The first pulsed electrical signal 42 propagates along the first trace 20. Control circuitry 40 also causes the second trace driver 36 to produce a second pulsed electrical signal 48 of a selected voltage 50 and a selected width 52 as shown in FIG. 1*c*. Referring again to FIG. 1*a*, the control circuitry 40 also causes the signal delay generator 38 to delay the transmission of the second pulsed electrical signal 48 from the second trace driver 36 by a selected interval.

In operation, neither the first 42 nor the second 48 pulsed electrical signal is of sufficient voltage to cause the conduction of electricity across the illuminating material 24. However, in combination, the pulsed electrical signals 42 and 48 produce the activating signal which causes electricity to conduct across the illuminating material 24 and resultantly causes the illuminating material to emit light from the respective display location. Because the signals only combine when they converge along the transmission means 12, a display location is selected by varying the delayed transmission of the second pulsed electrical signal 48 from the second signal driver 36 relative to the transmission of the first electrical signal 42 from the first signal driver 34.

Referring again to FIG. 1*a*, the transmission means 14 includes a signal delay path 23. The signal delay path 23 introduces propagation delay equal to the time that it takes for the second pulsed electrical signal 48 to propagate along the entirety of the second trace 22, which is equal to the second trace distance divided by the second trace propagation velocity. Thus, when no delay is introduced by the signal delay generator 38, the first 42 and second 48 pulsed electrical signals converge to produce the activating signal at an extreme first end of the first trace 20 and an extreme second end of the second trace 22. The converging location preferably corresponds to the extreme upper left portion of the display area 18.

When the signal delay generator 38 delays the second pulsed electrical signal 48 by a time period equal to twice the length of time that it takes for the first pulsed electrical signal 42 to propagate along the entirety of the first trace 20, the signals 42 and 48 converge to produce the activating signal at the extreme second end of the first trace 20 and the extreme first end of the second trace 22, such location preferably corresponding to the extreme lower right portion of the display area 18. The activating signal may be produced at other selected display locations across the display area 18 by causing the signal delay generator 38 to delay the firing of the second pulsed electrical signal 48 relative to the transmission of the first signal 42. Thus, by selectively activating the plurality of display locations across the display area 18 a visual image may be produced.

Further control may be had by varying the pulse width of the first 42 and second 48 pulsed electrical signals. In the case of the substantially uniformly disposed illuminating material 24 of the first preferred embodiment as shown in FIG. 2, pulse widths may be narrowed or widened to produce an activating signal of varying width. The width of the activating signal determines the width of the display location.

Figure 3A:
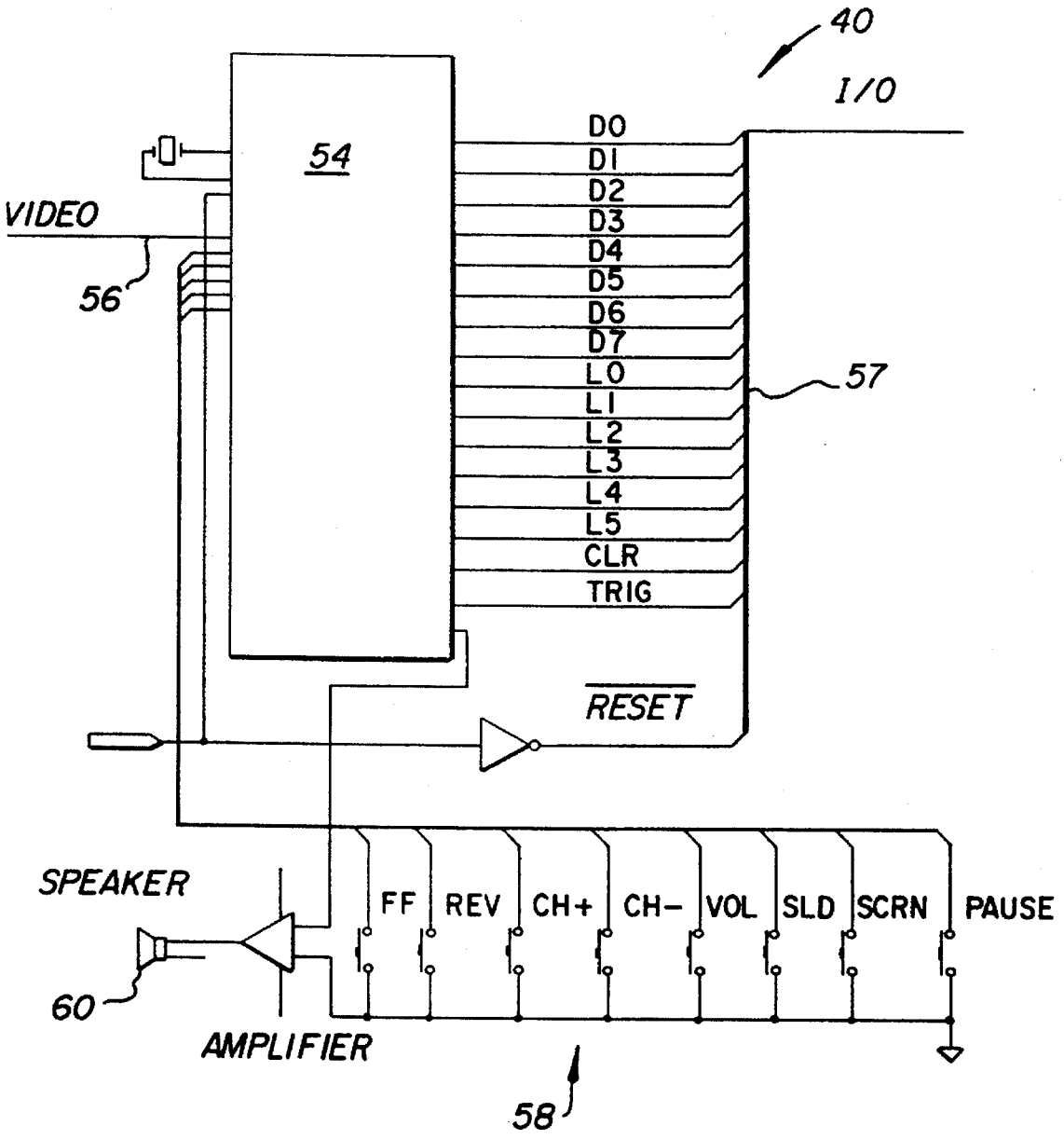
FIG. 3*a* is an diagrammatic top view of the first preferred embodiment of the transmission means along with an electrical schematic diagram of a first trace driver of the video display of the first preferred embodiment.
Figure 3B:
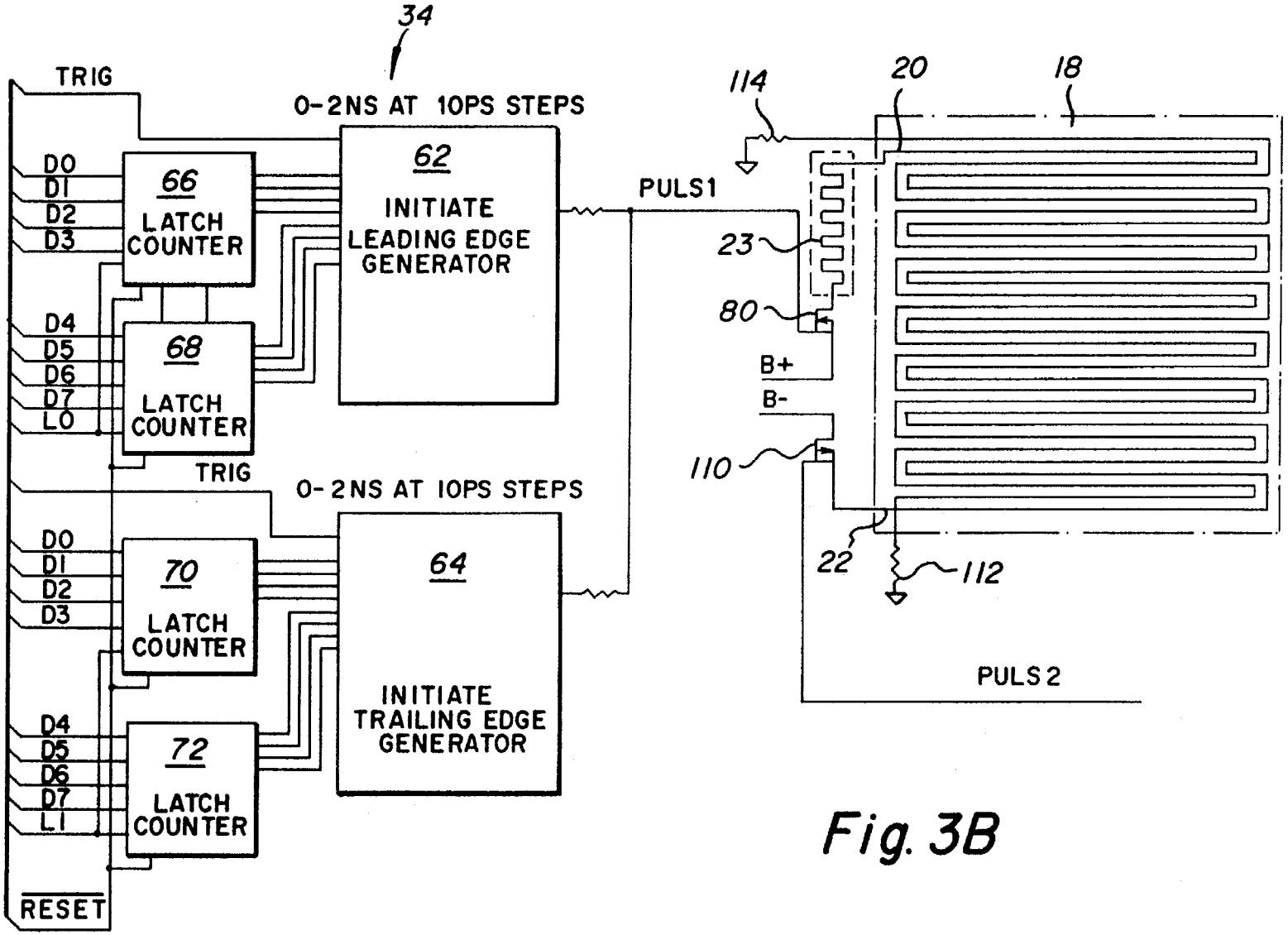
FIG. 3*b* is an electrical schematic diagram of a second trace driver and signal delay generator of the video display of the first preferred embodiment.
Figure 3C:
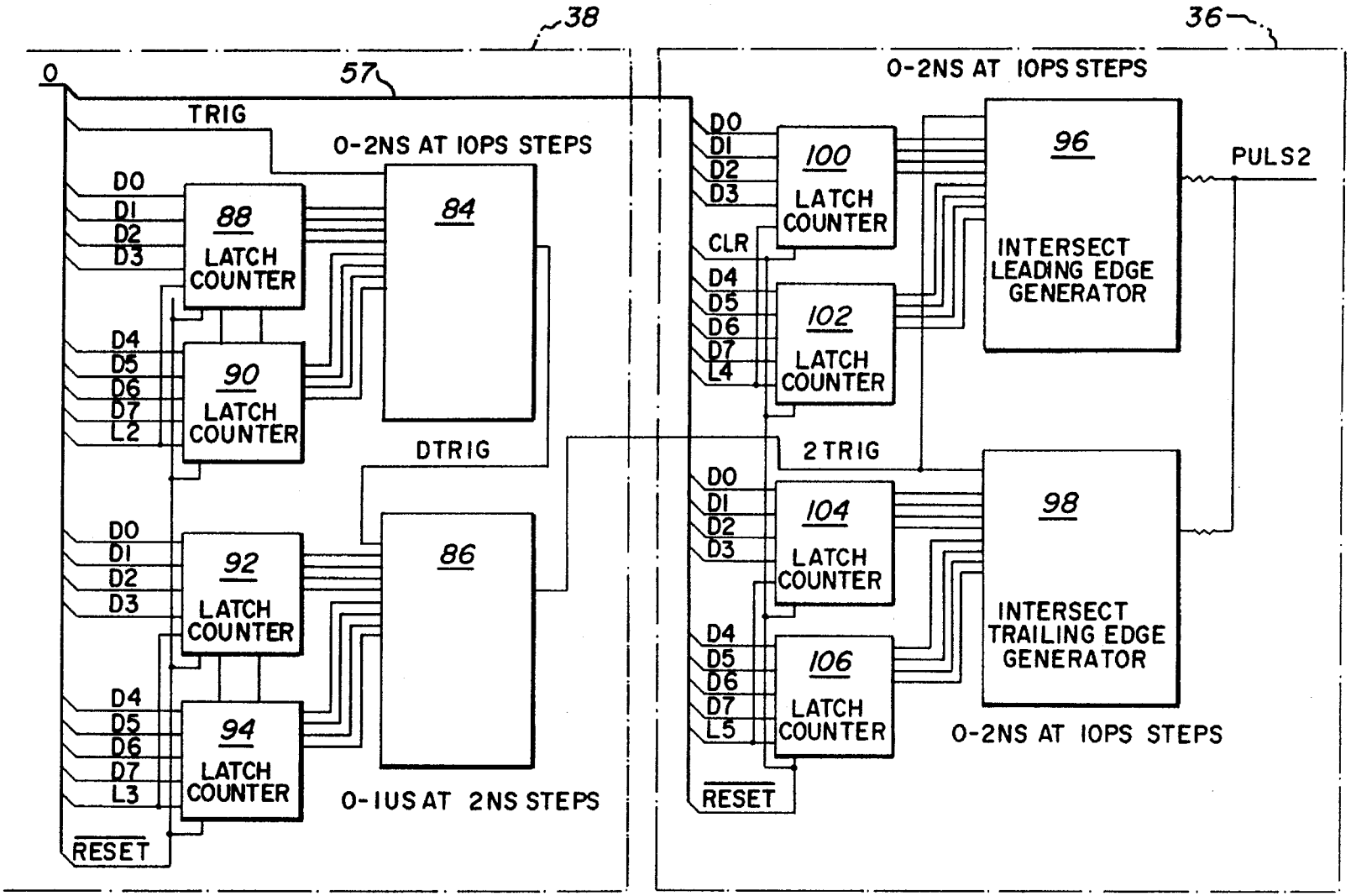
FIG. 3*c* is an electrical schematic diagram of a control circuit associated with the video display of the first preferred embodiment.

FIGS. 3*a*, 3*b*, and 3*c* shows in detail a first preferred embodiment of the signal control means 16 which drives the video display 10 shown in FIG. 1*a*. FIG. 3*a* shows control circuitry 40 which includes a microprocessor 54 for selectively controlling the first trace driver 34, the second trace driver 36, and the signal display generator 38 via Bus 57. The microprocessor 54 is preferably a Motorola 68HC0584 but could be any of a wide variety of controlling devices available. Microprocessor 54 is capable of converting analog video input 56 to digital data and using such data to create images on the display area 18. Control circuit 40 includes additional control inputs 58 and an audio output device 60 for providing an audio signal. Many variations of this control circuit are possible as will be appreciated by one skilled in the art.

The first trace driver 34 and the second trace driver 36 comprise identical components and, although separately controlled by the microprocessor 54, function in the same manner. Referring to FIG. 3*b*, the first trace driver 34 comprises a first pulse leading edge generator 62, a first pulse trailing edge generator 64, and latch counters 66, 68, 70, and 72.

Preferably, leading edge pulse generator 62 and trailing edge pulse generator 64 are AD9501 Digitally Programmable Delay Generators made by Analog Devices, Inc. These delay generators provide 10 picosecond resolution. Custom made components, however, would likely yield greater resolution than 10 picoseconds and could alternatively be used.

Latch counters 66 and 68 receive data from the microprocessor 54 over bus 57, the data on lines D0–D7 input into the latch counters when signal L0 is asserted. Other data may be input into latch counters 66 and 68 by introducing data on bus 57 and again asserting signal L0. Data held in latch counters 66 and 68 serves as input data to the leading edge generator 62. Latch counters 70 and 72 also receive data over the bus 57 in the same manner, data is latched into the latch counters by asserting signal L1 and held as input data for the trailing edge generator 64.

The leading edge generator 62 outputs a low to high edge on line PULS1 at or after signal TRIG is asserted. The time delay between receiving signal TRIG and outputting the low to high edge is determined by the input data supplied to leading edge generator 62 by latch counters 66 and 68. Trailing edge generator 62 pulls line PULS1 from high to low at some time after receiving signal TRIG, the delay between receiving signal TRIG and pulling line PULS1 from high to low being determined by the input data supplied by latch counters 70 and 72.

Both the leading edge generator 62 and the trailing edge generator 64 are triggered by signal TRIG, and therefore the data input to the generators determines the delay in transmission and resultantly the width of signal PULS1. In a normal mode of operation, the leading edge of signal PULS1 is transmitted upon receipt of signal TRIG without added delay and the output of generator 64 is delayed to produce a signal of a desired width.

Signal PULS1 drives first pulse transistor 80, causing the transistor to output a pulse of the selected height 44 and width 46. The output from first pulse transistor 80 propagates along the first trace 20.

Referring now to FIG. 3*c*, the signal delay generator 38 comprises a first delay generator 84 and a second delay generator 86, both of which are also preferably model AD9501 Digitally Programmable Delay Generators made by Analog Devices, Inc. Latch counters 88 and 90 receive data over lines D0–D7 on bus 57 from the microprocessor and latch the data when signal L2 is enabled. New data may be input in latch counters 88 and 90 by again asserting signal L2. The data in latch counters 88 and 90 inputs into the first delay generator 84, causing the first delay generator to produce a signal DTRIG between 0 and 2 nanoseconds after receiving signal TRIG. Here, also, the resolution on the delay of signal DTRIG is 10 picoseconds.

The second delay generator 86 also receives data from microprocessor 54 over bus 57. Latch counters 92 and 94 latch data when signal L3 is asserted, the latched data held as input to the second delay generator 86. Other data may is input into the latch counters 92 and 94 by again asserting signal L3. Upon or after receipt of DTRIG from the first delay generator 84, the second delay generator 86 asserts signal 2TRIG. The delay in asserting DTRIG is determined by the data input to the second delay generator 86 by latch counters 2TRIG 92 and 94. Preferably, the second delay generator 86 is programmable for between 0 and 1 microsecond of delay in intervals of 2 nanoseconds. Therefore, the signal delay generator 38 as a whole is capable of producing signal 2TRIG after the receipt of signal TRIG with an intervening delay of between 0 and 1.002 microseconds with a resolution increment of 10 picoseconds.

Signal 2TRIG then triggers the second trace driver 36. Referring to FIG. 3*c*, the second trace driver 36 is preferably identical to the first trace driver 34. The second trace driver comprises a second pulse leading edge generator 96, a second pulse trailing edge generator 98, and latch counters 100, 102, 104, and 106. Latch counters 100 and 102 receive data from the microprocessor 54 over bus 57, the data on lines D0–D7 input into the latch counters when signal L4 is asserted. Additional data may be input to the latch counters 100 and 102 by introducing data on bus 57 and again asserting signal L4. Such data is then held as input data for leading edge generator 96.

Latch counters 104 and 106 receive data over bus 57 in the same manner, the data latched by asserting signal L5. Latch counters 106 and 108 provide input data to trailing edge generator 98. Leading edge generator 96 develops a low to high signal on line PULS2 at or some time after receiving signal 2TRIG. The delay time is determined by the input data supplied to leading edge generator 96 by latch counters 102 and 104. Preferably, leading edge generator 96 asserts upon receipt of signal 2TRIG without added delay.

The trailing edge generator 98 pulls the signal on line PULS2 from high to low at some time after receiving signal 2TRIG. Data latched on latch counters 106 and 108 and input to trailing edge generator 98 determines the delay between receiving signal 2TRIG and pulling the signal PULS2 from high to low. Signal 2TRIG triggers both the leading edge generator 96 and the trailing edge generator 98, and therefore the delay of signal PULS2 is referenced to the receipt of signal 2TRIG.

Referring again to FIG. 3*b*, signal PULS2 inputs into a second pulse transistor 110, enabling the transistor to transmit a pulse of the selected height 50 and width 52 along the second trace 22.

In operation, the microprocessor 54 programs the first trace driver 34 to transmit a first pulsed electrical signal 42 of a selected height 44 and width 46 along the first trace 20. The microprocessor 54 also programs the second trace driver to transmit a second pulsed electrical signal 48 of a selected height 50 and width 52 along the second trace 22. Further, the microprocessor programs the signal delay generator 38 to delay the transmission of the second pulsed electrical signal 48 by a certain delay. In this manner, the selective control of the height, width, and transmission of the pulsed electrical signals causes the convergence of the electrical signals at a selected display location along the transmission means 14. The selective convergence produces the activating signal at the selected display location and causes the display means 12 to emit light from the selected display location.

To prevent reflections on the transmission means 14, the first trace 20 and second trace 22 are terminated into terminating resistors 112 and 114 respectively. First pulsed electrical signal 42 propagates along the transmission means 14 from the first transistor 80 until it reaches a first terminating resistor 112. The first terminating resistor 112 provides a path to ground for the first pulsed electrical signal 42, prevents reflections, and therefore prevents the inadvertent convergence of signals at undesired locations. The second terminating resistor 114 performs the same function for the second trace 22.

Figure 4:
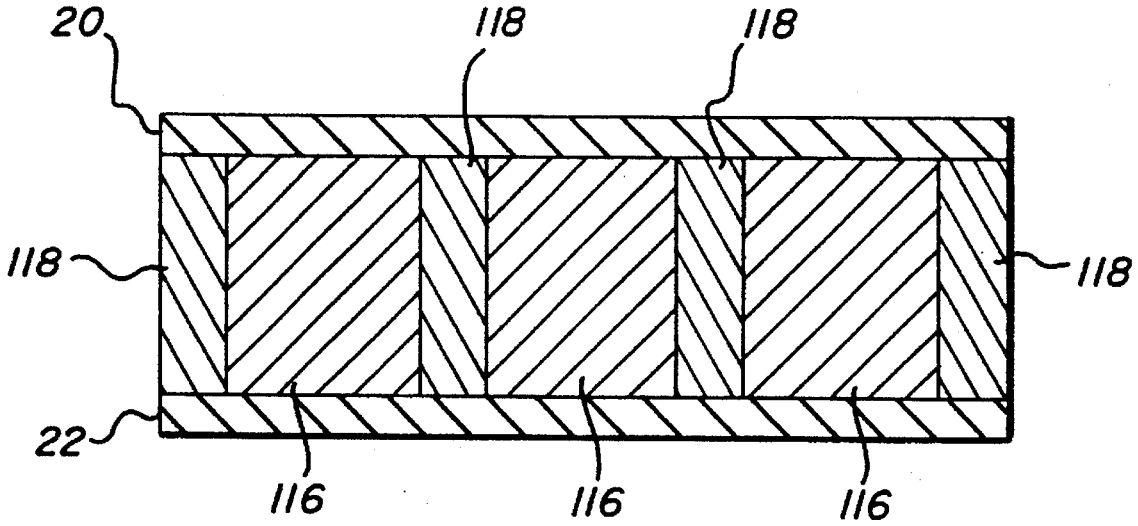
FIG. 4 is a partial top diagrammatic view of a second preferred embodiment of the display means including discretely disposed illuminating pixels.

FIG. 4 shows a second preferred embodiment of the display means 12. This embodiment of the display means 12 includes a plurality of illuminating pixel means, one of the illuminating pixel means disposed at each of the plurality of display locations, each illuminating pixel means for emitting light from its respective display location upon receipt of an activating signal at the respective display location. As shown in FIG. 4, discretely disposed pixels 116 are located at each display location such that the first and second pulsed signals 42 and 48 may converge to produce the activating signal at the selected display location. Pixels are bounded by the first and second traces 20 and 22 and electrically insulating boundaries 118, forming discrete display location. Not shown in this view is a transparent protective layer.

With the embodiment of the display means 12 shown in FIG. 4, a color monitor may be easily constructed. Pixels of red, blue and green illuminating material may be discretely disposed at the display locations such that the signal control means 16 selectively illuminates the pixels to create a colored visual image.

Figure 5:
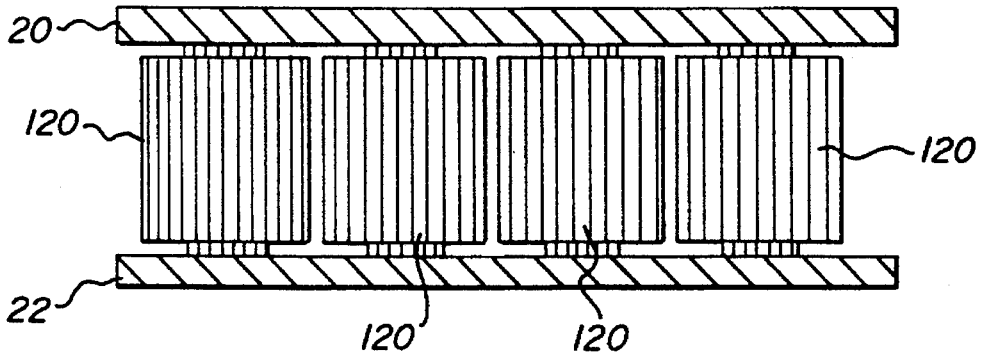
FIG. 5 is a partial diagrammatic top view of a third preferred embodiment of the display means including discretely disposed liquid crystal display segments.

FIG. 5 shows a third preferred embodiment of the display means 12. This embodiment of the display means 12 includes a plurality of liquid crystal display means, one of the liquid crystal display means disposed at each of the plurality of display locations. Each liquid crystal display means is for changing the visual appearance of its respective display location upon receipt of an activating signal at the respective display location. As shown in FIG. 5, discretely disposed liquid crystal diodes 120 are located at each display location such that the first and second pulsed signals 42 and 48 may converge to produce the activating signal at each display location. The discretely disposed liquid crystal diodes 120 are bounded by the first trace 20 and the second trace 22. In this embodiment, the display means 12 does not produce visual light, but instead, alters the visual appearance of each display location when the activating signal is produced at that respective display location.

Figure 6:
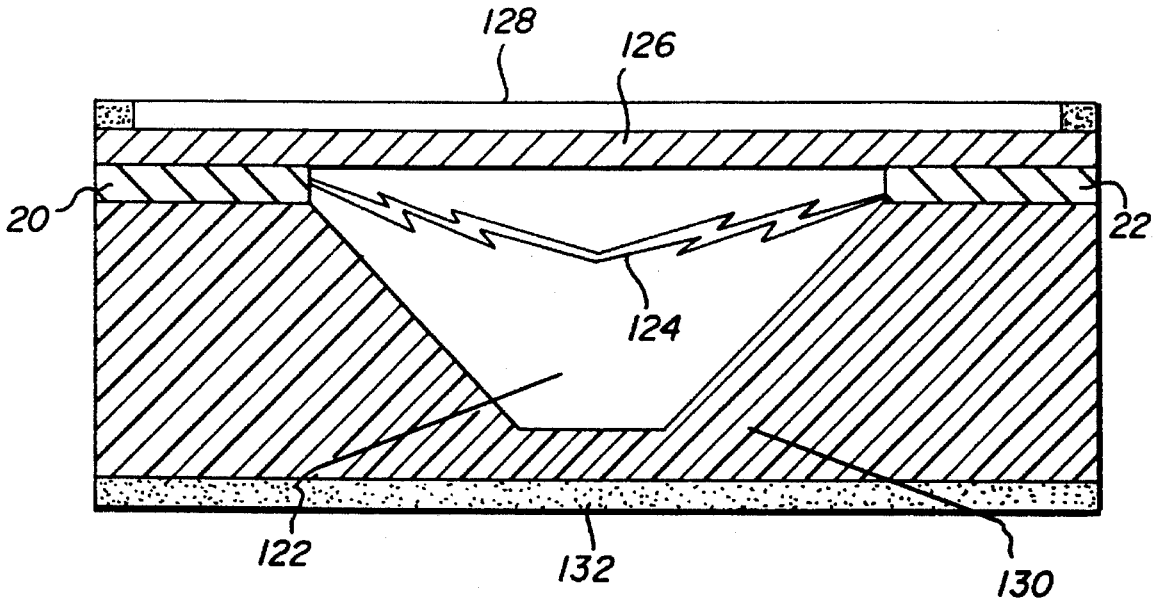
FIG. 6 is a partial cross-sectional diagrammatic view of a fourth preferred embodiment of the display means using a gas discharge illuminating technique.

FIG. 6 shows a fourth preferred embodiment of the display means 12 including gas discharge illumination means associated with the display area for emitting light from the selected display location upon receipt of an activating signal at the selected display location. As shown in FIG. 6, gas discharge illumination means includes a gas filled cavity 122, the gas in the cavity producing ultraviolet radiation when an electrical arc 124 conducts across it. Such an arc 124 is produced when the first pulsed electrical signal 42 and the second pulsed electrical signal 48 converge at the selected display location to produce the activating signal. The ultraviolet radiation, in turn, causes an illuminating pixel element 126 to produce visible light. A transparent pixel cover 128 protects the structure. A non-conducting screen base 130 contains the gas within the cavity 122 and allows the first and second traces 20 and 22 to be deposed. A mounting substrate 132 preferably provides protection and rigidity to the structure. With this embodiment as well, a color monitor could easily be constructed. Illuminating pixel elements 126 of red, blue and green colors could be discretely disposed at the display locations such that the signal control means 16 could selectively illuminate the pixels to create a colored visual image.

Figure 7A:
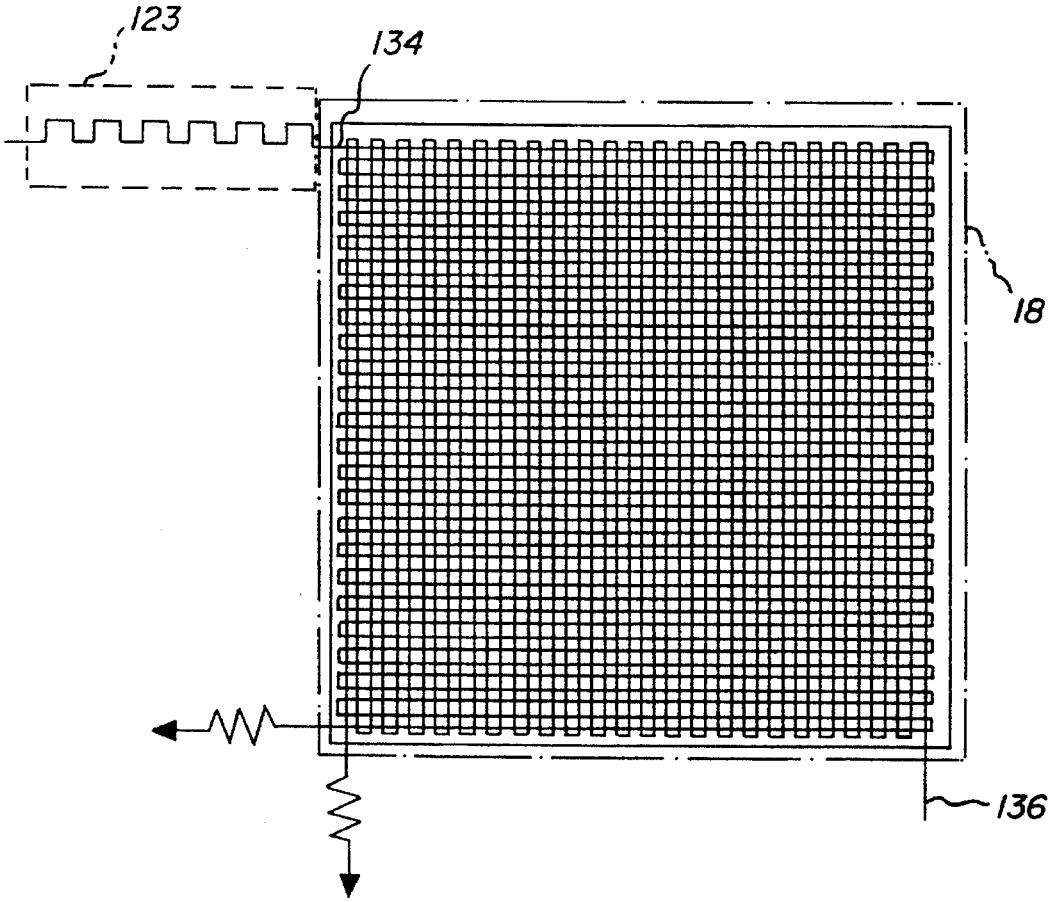
FIG. 7*a* is a diagrammatic top view of a second preferred embodiment of the transmission means.
Figure 7B:
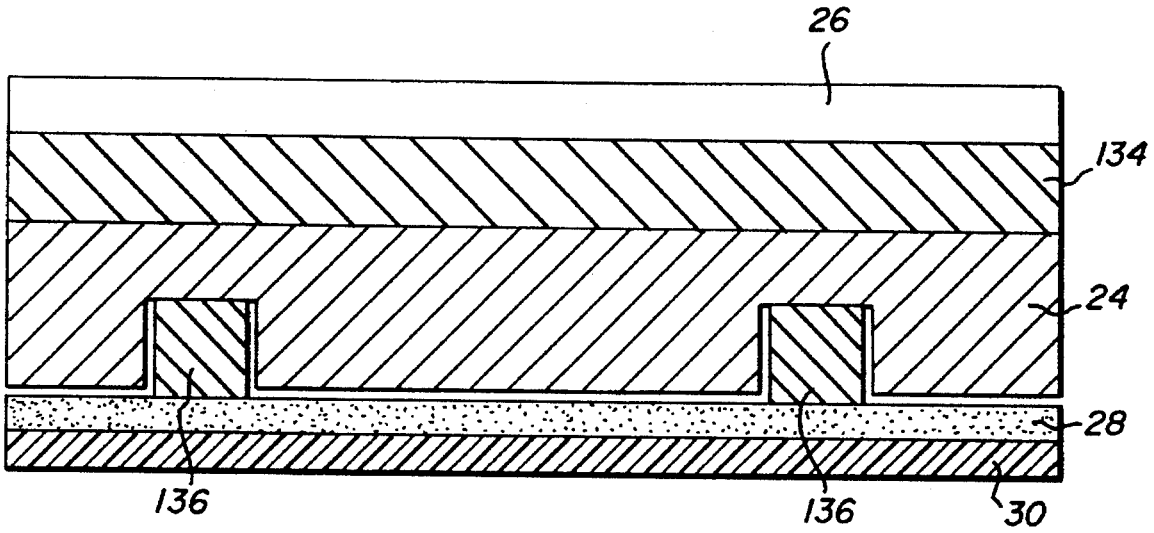
FIG. 7*b* is a partial cross-sectional diagrammatic view of the second preferred embodiment of the transmission means.

FIG. 7*a* is a diagrammatic top view and FIG. 7*b* is a diagrammatic partial cross-sectional view of a second preferred embodiment of the transmission means 14. Referring to FIG. 7*a*, the second preferred embodiment of the transmission means includes a row trace 134 forming a plurality of substantially parallel rows and providing a continuous propagation path that extends through each of the plurality of display locations. This embodiment also includes a column trace 136 forming a plurality of substantially parallel columns oriented substantially perpendicularly to the plurality of substantially parallel rows formed by the row trace 134. The column trace 136 also provides a continuous propagation path that extends through each of the plurality of display locations. The row 134 and column 136 traces are substantially electrically isolated from each other and converge at each of the plurality of display locations across the display area 18.

Referring to FIG. 7*b*, the row trace 134 and the column trace 136 converge at a plurality of display locations. Illuminating material 24 forms a path through which electricity may conduct from the row trace 134 to the column trace 136 when the activating signal is produced at the display location. This embodiment also includes a protective cover 26, an insulating substrate layer 28, and a grounded conducting layer 30 that enables the uniform propagation of the first 42 and second 48 pulsed electric signals along the transmission means 14.

In operation, this embodiment works similarly to the first preferred embodiment. The first pulsed electrical signal 42 propagates through the signal delay path 123 and then along the first trace 20. The selectively delayed second pulsed electrical signal 48 propagates along the second trace 22. The selective delay causes the first 42 and second 48 pulsed electrical signals to converge at a selected display location to produce the activating signal. Resultantly, the display location illuminates. Here again, the selective illumination of display locations facilitates the creation of visual images on the video display 10.

Figure 8A:
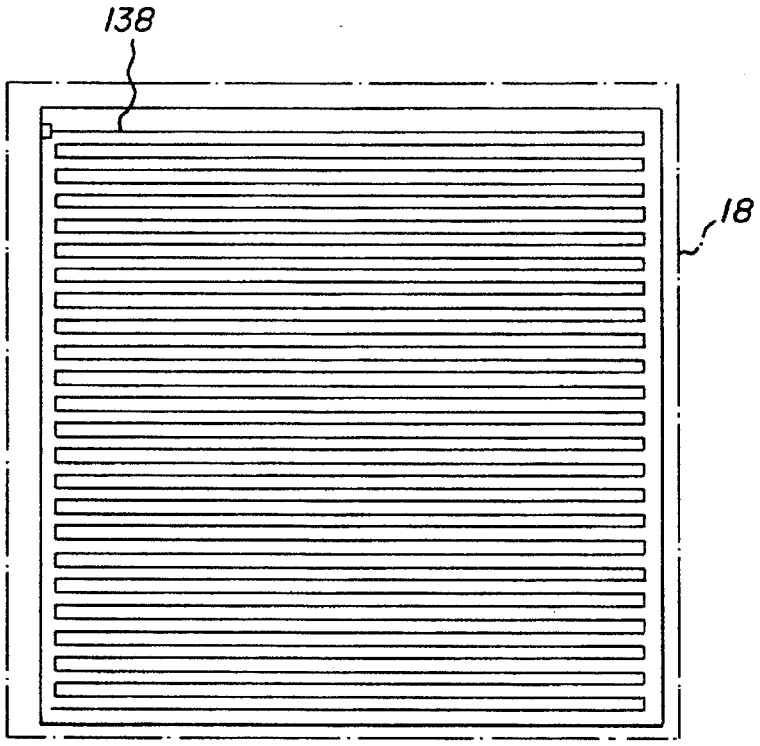
FIG. 8*a* is a diagrammatic top view of a third preferred embodiment of the transmission means.
Figure 8B:
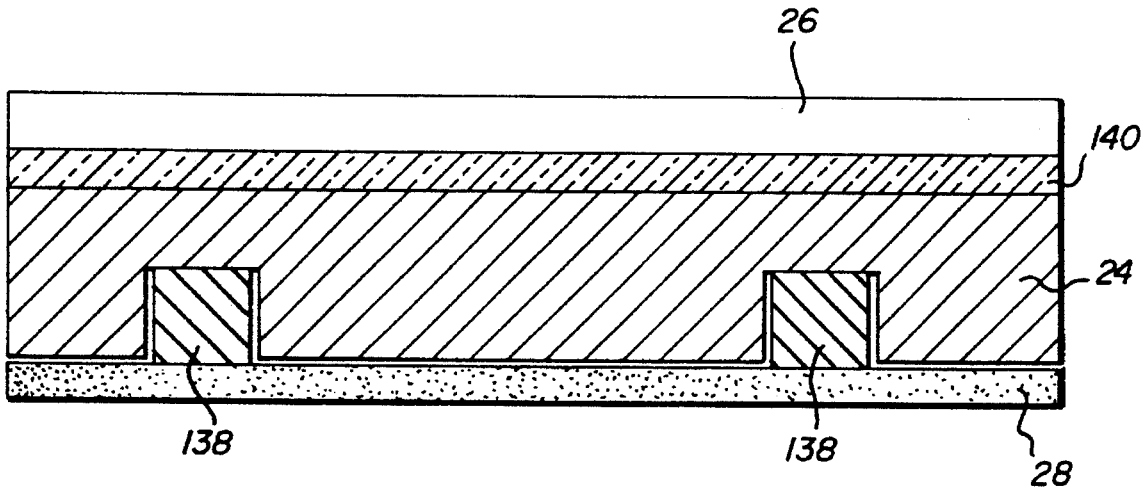
FIG. 8*b* is a partial cross-sectional diagrammatic view of the third preferred embodiment of the transmission means.

FIG. 8*a* is a diagrammatic top view and FIG. 8*b* is a diagrammatic partial cross-sectional view of a third preferred embodiment of the transmission means 14. Referring to FIG. 8*a*, the third preferred embodiment of the transmission means 14 includes a trace 138 forming a plurality of substantially parallel rows and providing a continuous propagation path that extends through each of the plurality of display locations across the display area 18. In this embodiment, the trace 138 is unterminated such that a signal propagating along the trace will fully reflect when it reaches the end of the trace. The selective convergence of the first 42 and second 48 pulsed electrical signals, each propagating along the trace 138 produces the activating signal.

Referring again to FIG. 8*b*, illuminating material 24 forms a path through which electricity may propagate from a location along the trace 138 to either a grounded propagation layer 140 or to another location along the trace depending upon the polarity of the signals propagating along the trace 138. This embodiment also preferably includes a protective cover 26, and an insulating substrate layer 28. The grounded propagation layer 140, preferably in the form of a transparent conductive grid, in addition to providing a return path for the conducted electricity also enables the uniform propagation of the first 42 and second 48 pulsed electric signals along the trace 138.

Referring to FIG. 8*a*, an activating signal may be produced in one of two ways using this embodiment of the transmission means. If both the first 42 and second 48 pulsed electrical signals are of positive voltage, the signals converge at a single physical point along the trace 138, adding to produce a voltage of sufficient magnitude to conduct across the illuminating material 24 to the grounded propagation layer 140, and resultantly causing the illuminating material 24 to emit light. If the first pulsed electrical signal 42 is of a positive voltage and the second pulsed electrical signal 48 is of a negative voltage, the signals will converge to produce the activating signal when they pass near each other, each pulse at a different location along the trace 138. In this case, electricity conducts from one portion of the trace 138 to another portion of the trace through the illuminating material 24 thereby producing the activating signal.

Figure 9A:
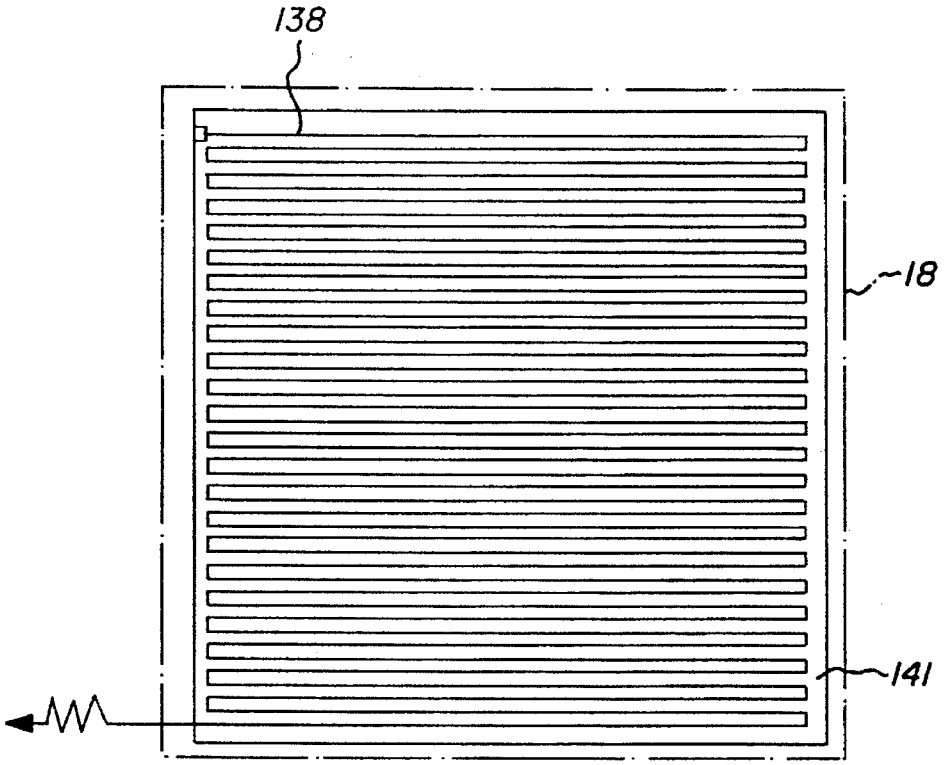
FIG. 9*a* is a diagrammatic top view of a fourth preferred embodiment of the transmission means.
Figure 9B:
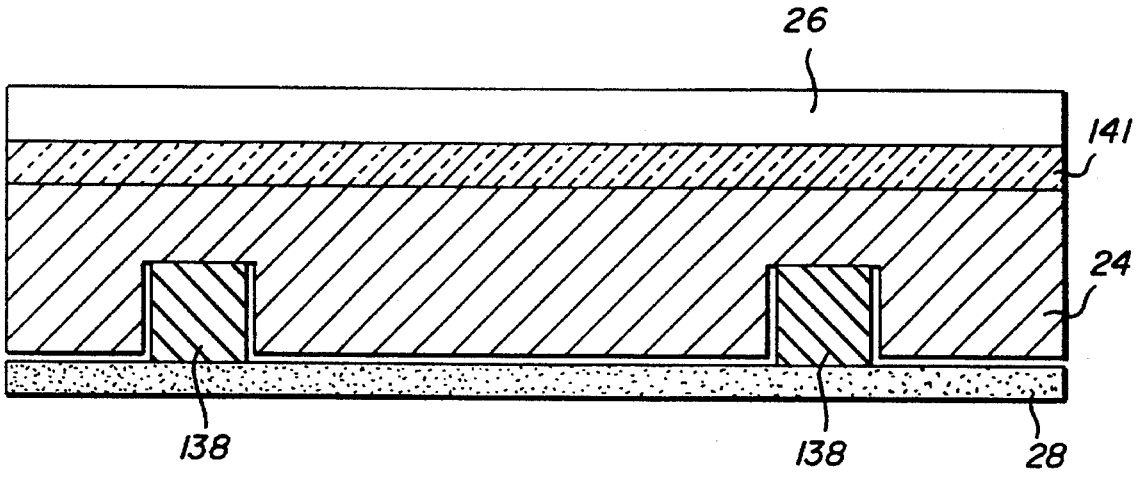
FIG. 9*b* is a partial cross-sectional diagrammatic view of the fourth preferred embodiment of the transmission means.

FIG. 9*a* is a diagrammatic top view and FIG. 9*b* is a diagrammatic partial cross-sectional view of a fourth preferred embodiment of the transmission means 14. Referring to FIG. 9*a*, the fourth preferred embodiment of the transmission means 14 includes a trace 138 forming a plurality of substantially parallel rows and providing a continuous propagation path that extends through each of the plurality of display locations. This embodiment also includes surface propagation means 141 substantially electrically isolated from and substantially coextensive with the trace across the display area 32, the surface propagation means for enabling the second pulsed electrical signal 48 to propagate substantially uniformly across the display area 18.

As shown in FIG. 9*b*, the surface propagation means 141 preferably takes the form of a transparent conductive grid. In this embodiment, the first pulsed electrical signal 42 propagates along the trace 138. The second pulsed electrical signal 48 propagates along the surface propagation means 141 such that the signals converge to produce the activating signal at the selected display location.

Illuminating material 24 forms a path through which electricity may propagate to the surface propagation means 141 when the activating signal is produced at the display location. This embodiment also includes a protective cover 26, and an insulating substrate layer 28. The surface propagation means 141, in addition to directing the second pulsed electrical signal 48, also enables the uniform propagation of the first pulsed electric signal 42 along the trace 138. The surface propagation means 141 may be constructed in such a manner so that the second pulsed electric signal 48 propagates uniformly along one dimension of the screen thereby making the selective convergence of signals easier to control.

Figures 10A, 10B, 10C:
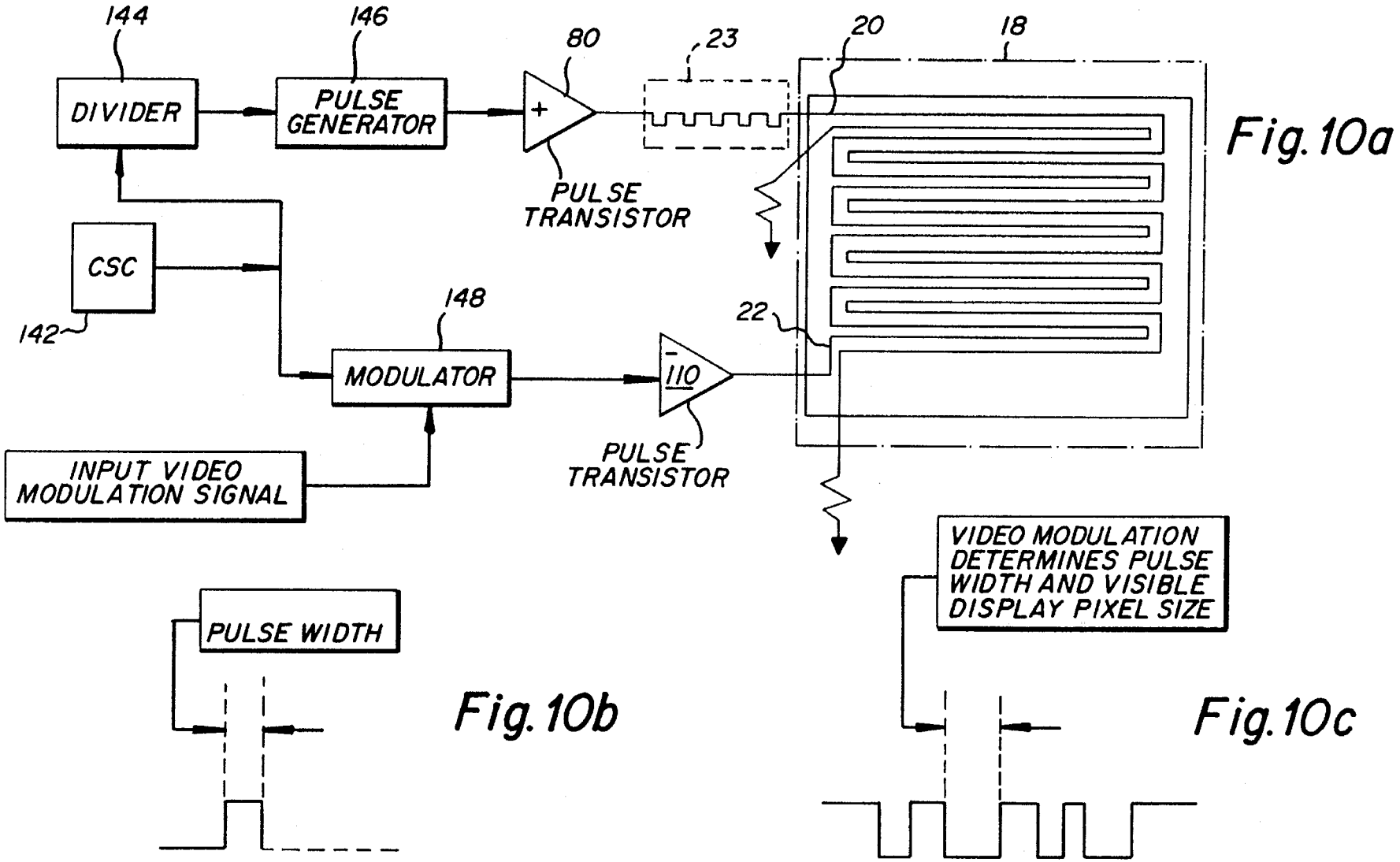
FIG. 10*a* is a diagrammatic view of a second preferred embodiment of a video display embodying the principles of the present invention, including a display means, a transmission means, and signal control means.
FIG. 10*b* is a diagrammatic view of a first signal to be transmitted along the transmission means included in the video display of FIG. 10*a*.
FIG. 10*c* is a diagrammatic view of a second signal to be transmitted along the transmission means included in the video display of FIG. 10*a*.

The apparatus of the present invention also includes an alternate preferred embodiment of the signal control means 16. Referring to FIG. 10*a*, this embodiment of the signal control means 16 is described in combination with the first preferred embodiment of the display means 12 and first preferred embodiment of the transmission means 14, both described above. In this embodiment, as shown in FIG. 10*b*, a first pulsed signal comprises a single pulse of a selected height and width with a selected period. A second pulsed signal, however, as shown in FIG. 10*b* comprises a plurality of negative peaks, the combination of these peaks forming a second pulsed signal train.

Referring to FIG. 10*a*, when the first pulsed signal and the second pulsed signal train are transmitted from the first 80 and the second 110 transistors at the same time, the first pulsed signal and the beginning of the second pulsed signal train converge at the extreme first end of the first trace 20. Then, as the first signal continues to propagate along the first trace 20 and the second pulsed signal train continues to propagate along the second trace 22, the signals continues to converge across the display area 18 and produced activating signals at various selected activating locations. Activating signals are produced at locations where the positive peak of the first pulsed signal converges with the negative peaks of the second pulsed signal train.

The second pulsed signal train is twice as long as the second trace 22. Therefore, when the first pulsed signal reaches the extreme lower right portion of the display area 18, it converges with the end of the second pulsed signal train. The width of the individual negative peaks and their location along the second pulsed signal train are selected so that selected display locations may be illuminated to produce a visual image.

In this embodiment of the signal control means 16, each display location on the display area may be updated at a rate that is dependent only upon the duration of the second pulsed signal train. For example, suppose it takes 10 microseconds for the second pulsed signal train to propagate along the entirety of the second trace. In that case, the trailing edge of the second pulsed signal train propagates to the second terminating resistor 112 approximately 20 microseconds after the leading edge of the second pulsed signal train begins to propagate along the second trace 22. Because both the first pulsed signal and the second pulsed signal train must have exited the display area 18 before more pulses may be transmitted along the traces, the video display may be updated every 20 microseconds. A standard television screen updates approximately once every 33 milliseconds.

Referring to FIG. 10*a*, a high frequency oscillator 142 produces a sine wave with a selected frequency of oscillation. The frequency of the high frequency oscillator 142 is selected so that the oscillator produces a sine wave with a narrow pulse width, preferably between 1 and 10 picoseconds. The oscillator output is input into divider 144. The divider 144 is selected such that the output of the divider is a sine wave with a period equal to twice the propagation delay along the second trace 22. The divider output is then input into a pulse generator 146, triggering the pulse generator on a negative to positive zero crossing. Responsively, the pulse generator 146 produces a narrow pulse, preferably less than 10 picoseconds, the period equal to twice the propagation delay along the second trace 22. The output from the pulse generator is then input into the first pulse transistor 80 which drives the first trace 20.

The output from the high frequency oscillator 142 is also input into a second signal modulator 148 along with an input video modulation signal 147. The output from the second signal modulator 148, as shown in FIG. 10*b* is then input into the second pulse transistor 110, the output from which drives the second trace 22. The signal driving the second pulse transistor potentially can produce an activating signal at each of the plurality of display locations. The selective disablement by modulation of individual portions of the second pulsed signal train facilitates the selective enablement and partial enablement of each display location across the display area, thus creating a visual image.

Figure 11:
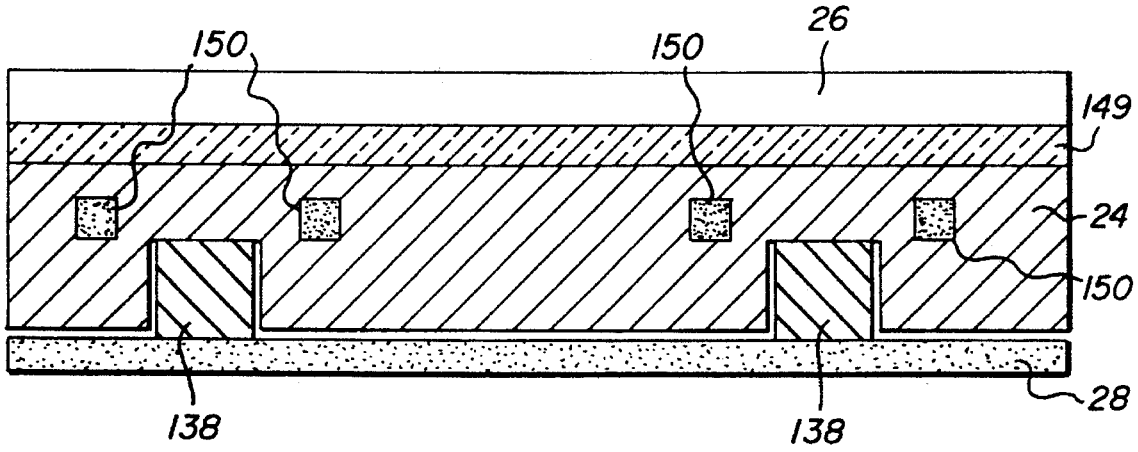
FIG. 11 is a partial cross-sectional diagrammatic view of an alternate preferred embodiment of the present invention including display continuation means.

The apparatus of the present invention also includes display continuation means for enabling the display means 12 to produce continued display signals at the respective selected display locations after receipt of the activating signals at the selected display locations. FIG. 11 shows a partial diagrammatic cross-section view of the third preferred embodiment of the transmission means 16 including display continuation means. At each activating location, two energized traces 150 are positioned opposite each trace 138. The energized traces 150 are energized at a voltage relative to the grounded conducting surface. The voltage on the traces 150 is below the level of the activating signal but is large enough to cause the current through the illuminating material 24 to continue to flow once the activating signal has initiated current flow through the illuminating material 24. A grounded propagation layer 149 allows current to flow from each energized trace through the illuminating material 24 until a deactivating signal is applied across that particular display location. The deactivating signal is a negative voltage signal applied to the particular display location which causes the current flow through the illuminating material at that location to cease.

The present invention also includes a feature for enhancing the operation of the display means 12 and transmission means 14 by increasing the conductivity of the paths through which electricity must pass at each display location. With the display means 12 and the transmission means 14 of the first preferred embodiment, for example, the conductivity from the first trace 20 to the second trace 22 is determined by the material separating the traces. The features demonstrated in FIGS. 12*a*, 12*b*, 12*c*, and 12*d* show how the conductivity between the traces 20 and 22 may be reduced by reducing the distance between the traces at each of the display locations. Such features facilitate simpler signal control by preventing inadvertent convergence of signals and preferred conduction paths between the traces.

Figure 12A:
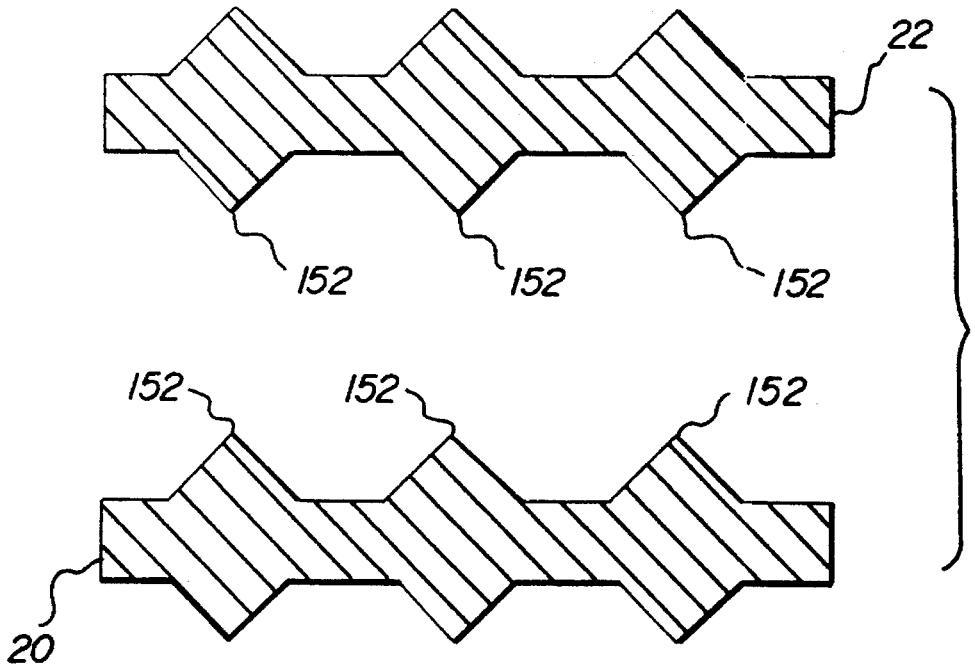
FIGS. 12*a*, 12*b*, 12*c*, and 12*d* are partial diagrammatic views of alternate physical constructions of traces wherein the physical distance between the traces decreases at a display location.

Referring particularly to FIG. 12*a*, the first trace 20 and the second trace 22 both include excursion points 152 that decrease the physical distance between the traces. Resultantly, the conductivity between the two traces is enhanced between the points 152 and electricity is more likely to flow between the points 152. Resultantly, the definition of the screen may be enhanced with this arrangement.

Figure 12B:
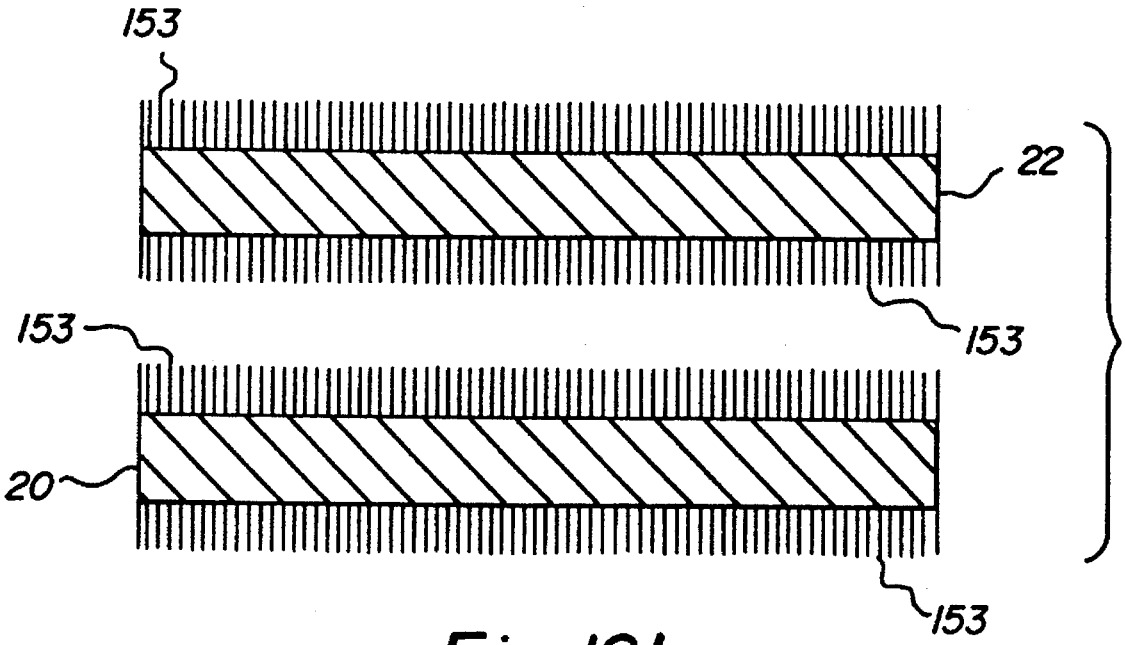
Figure 12C:
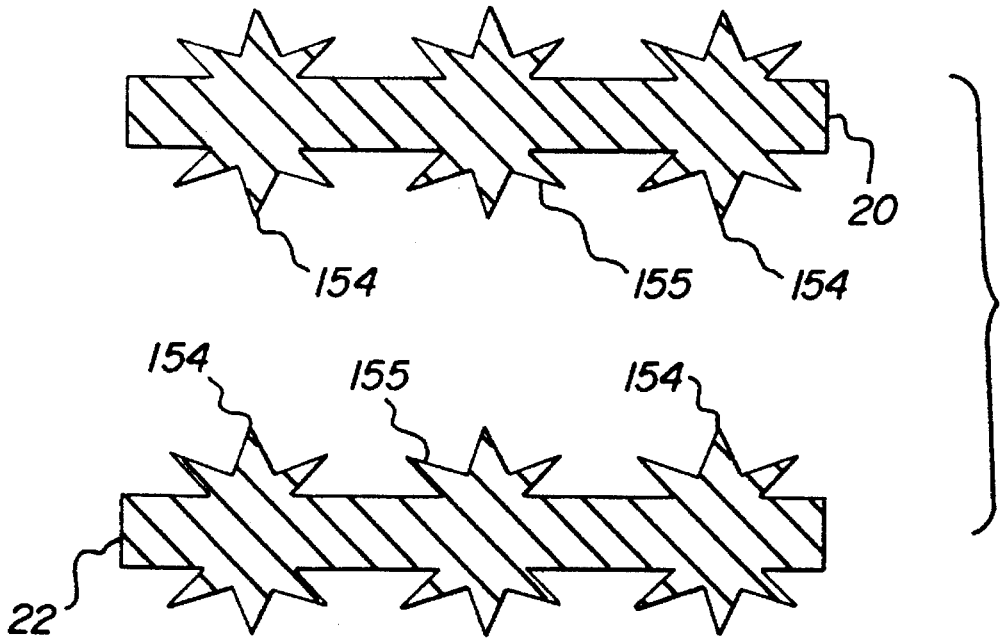
Figure 12D:
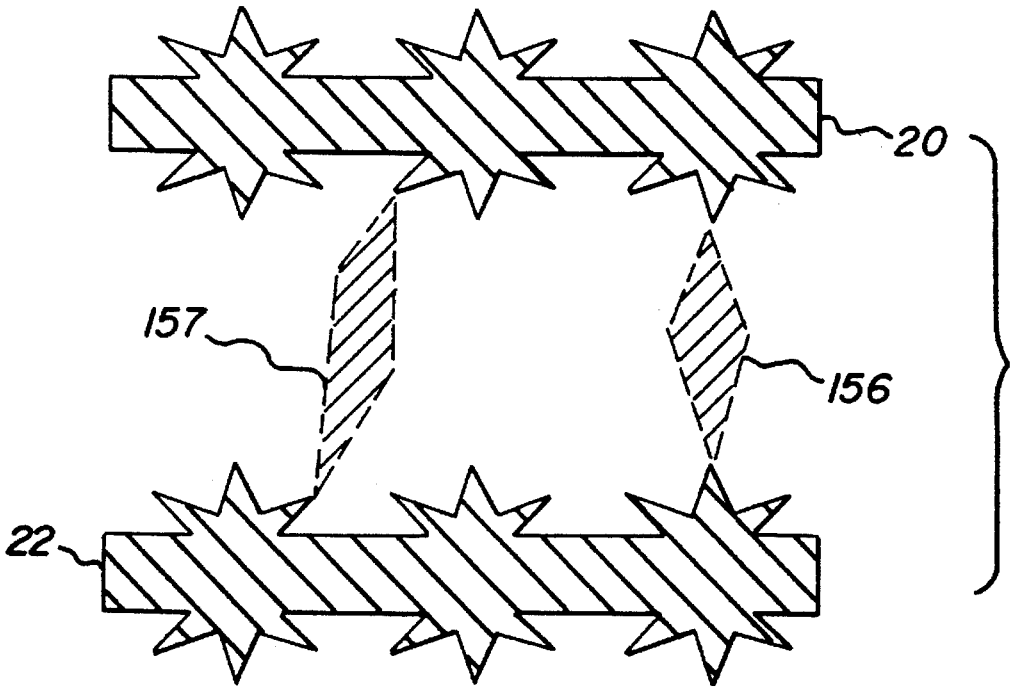

Varying designs for enhancing the conductivity between the traces 20 and 22 may be designed to perform differing purposes. Referring to FIG. 12*b*, the first trace 20 and the second trace 22 both include excursion lines 153 which enhance the conductivity between the traces at those location. Excursion lines of this type operate to achieve softer images. As shown in FIG. 12*c* and 12*d*, A complex design may be created that includes a multiplicity of excursion points at each display location. In this embodiment, central excursion points 154 are used to direct electrical arcs 156 from one central excursion point 154 to another central excursion point 154 when the first 42 and 48 electrical signals converge at opposing central excursion points 156. Further, lateral excursion points 155 enhance the conductivity of the display means 12 to create an electrical arc 157 from one lateral excursion point to another lateral excursion point when the signals 42 and 48 converge to produce the activating signal across lateral excursion points 155.

Figure 13:
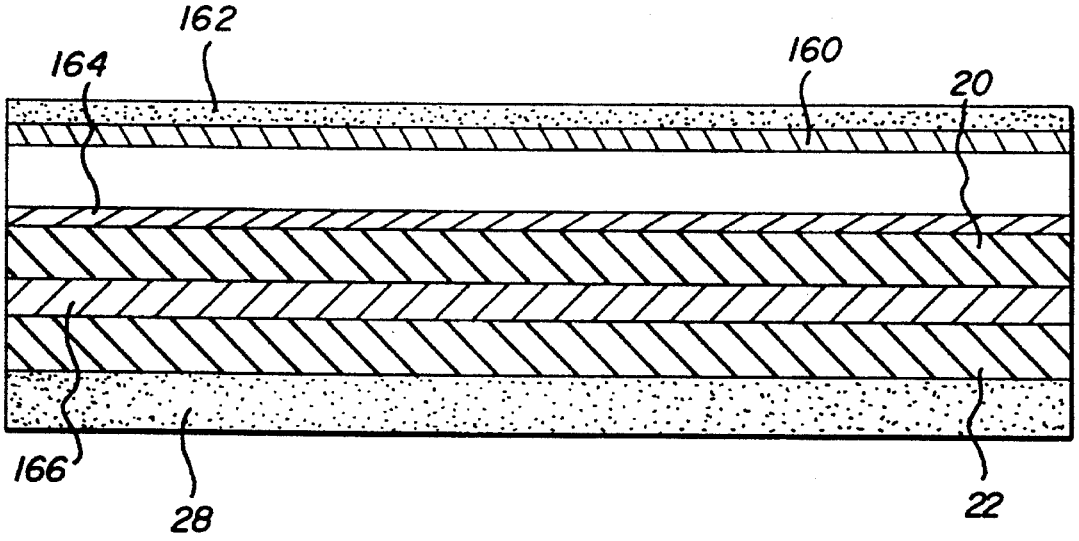
FIG. 13 is a partial cross-sectional diagrammatic view of a fifth preferred embodiment of the display means including a viewing screen coated with an illuminating material selectively energized by bombarding electrons.

The apparatus of the present invention also includes a fifth preferred embodiment of the display means 12. FIG. 13 shows a partial cross-sectional diagrammatic view of a fifth preferred embodiment of the display means 12. A viewing screen surface 162 is preferably coated with a phosphor material 160 but could be coated with another material that emits light when bombarded by electrons. The viewing screen surface 162 serves as an anode. The first trace 20 includes a low work function coating 164 that facilitates the escape of electrons from the trace. The first trace 20 is preferably nearer the viewing screen surface 162 than is the second trace 22, the traces separated by a insulating layer 166, and the traces supported by an insulating substrate layer 28.

This embodiment of the display means 12 is selectively activated by the convergence of a first pulse 42 of a negative polarity and a second pulse 48 of a negative polarity. When the first 42 and second 48 pulses converge at a selected location, the combined voltage on the first 20 and second 22 traces causes electrons to emit from the first trace at the selected location. The electrons are attracted by the viewing screen surface 162 which acts as an anode. Resultantly, the electrons collide with the illuminating material 160 on the viewing screen surface 162 causing the illuminating material to emit light. As will be readily appreciated by one skilled in the art, a number of variations of this apparatus using an anode and a cathode to cause the selective emission and bombardment of a screen by electrons are possible.

The present invention also includes a method for selectively activating any of a plurality of different display locations across a display area. Such method embodies the principles of the present invention. As a first step, the method includes the step of selectively transmitting a first 42 and a second 48 pulsed electrical signal along a transmission means 14. The transmission means 14 provides at least one continuous propagation path that extends through each of the display locations 32. A second step of the method is directing the propagation of the first 42 and the second 48 pulsed electrical signals along the transmission means 14 such that the first and second pulsed electrical signals converge to produce an activating signal at a selected display location. And, a third step of method is the step of producing a display signal at the selected display location upon receipt of the activating signal at the selected location.

Alternate preferred embodiments of the method of the present invention include limitations introduced by the second, third, and fourth preferred embodiments of the transmission means 14. Those limitations were previously discussed. Further alternate preferred embodiments of the method of the present invention include limitations introduced by the second, third, and fourth preferred embodiments of the display means 12. Such limitations were also previously discussed.

The above described preferred embodiments are intended to illustrate the principles of the invention, but not to limit the scope of the invention. Various other embodiments and modifications to these preferred embodiments may be made by those skilled in the art without departing from the scope of the following claims.

We claim:

1. An apparatus for activating a selected discrete display location in a display area, the apparatus comprising:

(a) a display area including a plurality of discrete display locations sequentially and electrically communicative and spaced apart in two dimensions to define said display area;

(b) a display location activation signal structure associated with said display area, said signal structure including a first continuous propagation path extending through and in electrical communication with each one of said plural discrete display locations in a first linear sequence from an initial one to a terminal one of said plural discrete display locations, said first propagation path having a first end and a second end and a first path characteristic activation signal propagation velocity determined by the physical construction of said first propagation path;

said signal structure also including a second continuous propagation path extending through and in electrical communication with each one of said plural discrete display locations in a second linear sequence, said second linear sequence being the reverse ordered sequence of the first linear sequence, said second propagation path having a primary end and a secondary end and a second path characteristic activation signal propagation velocity determined by the physical construction of said second propagation path;

(c) said first and second continuous propagation paths arranged such that a first electrical signal applied at said first end of said first propagation path propagate along the first linear sequence of the plural discrete display locations at said first path characteristic activation signal propagation velocity, and a second electrical signal applied at said primary end of said second propagation path propagate along the second linear sequence of the plural discrete display locations at said second path characteristic activation signal propagation velocity; and (d) a first activation signal generator for producing said first electrical signal, said first signal generator connected to said first propagation path to propagate the first electrical signal through a primary subset of the plural discrete display locations along said first linear sequence, and a second activation signal generator for producing said second electrical signal, said second signal generator connected to said second propagation path to propagate the second electrical signal through a secondary subset of the plural discrete display locations along said second linear sequence so that said primary subset and said secondary subset include in total, each of the plural discrete display locations and include in common, only said selected discrete display location; and (e) a signal timing generator operatively connected to both first and second activation signal generators for controlling the timing of first electrical signal generation relative to said second electrical signal generation in timed dependence upon said first and second path characteristic activation signal propagation velocities to precipitate a timed convergence of said first electrical signal with said second electrical signal at said selected discrete display location.

2. A display element access structure comprising:

(a) a first signal path extending a first path distance from a first terminus to a second terminus, said first signal path having a first path characteristic signal propagation velocity determined by the physical construction of said first signal path;

(b) a second signal path extending a second path distance from a primary terminus to a secondary terminus, said second signal path having a second path characteristic signal propagation velocity determined by the physical construction of said second signal path;

(c) a set of discrete display elements arranged in a first linear sequence on and along said first signal path so that each selected member of said set of discrete display elements is a corresponding unique selected first signal propagation time from said first terminus, said first signal propagation time being dependent upon said first path characteristic signal propagation velocity;

(d) said set of discrete display elements also coincidentally arranged in a second linear sequence on and along said second signal path so that each selected member of said set of discrete display elements is a corresponding unique selected second signal propagation time from said primary terminus, said second signal propagation time being dependent upon said second path characteristic signal propagation velocity, said second linear sequence of the set of discrete display elements being the reverse ordered sequence of the first linear sequence of the set of discrete display elements thereby placing each member of the set of discrete display elements a first distance from the first terminus of said first signal path and a differing second distance from the primary terminus of said second signal path; and (e) a control circuit in electrical communication with said first terminus of said first signal path and inducing thereon a first signal propagated sequentially through a primary subset of the set of discrete display elements along said first linear sequence, said control circuit also in electrical communication with said primary terminus of said second signal path and inducing thereon a second signal propagated sequentially through a secondary subset of the set of discrete display elements along said second linear sequence, said primary subset and said secondary subset including in total, each of the members of said set of discrete display elements and including in common, only a determined member of the set of discrete display elements, said first and second signals sequenced in time by said control circuit to converge at said determined member of said set of discrete display elements according to the unique selected first signal propagation time and unique selected second signal propagation time corresponding to said determined member of said set of discrete display elements.

3. An accessing structure for a display area, said accessing structure comprising:

a plurality of discrete display elements each one of said plural discrete display elements being responsive to the convergence of a first signal with a second signal;

a first signal path extending a first path distance from a first terminus through and in sequential electrical communication with a first linear sequence composed of each one of said plural discrete display elements to a second terminus, said first signal path having a first path characteristic signal propagation velocity determined by the physical construction of said first signal path;

a second signal path extending a second path distance from a primary terminus through and in sequential electrical communication with a second linear sequence composed of each one of said plural discrete display elements to a secondary terminus, said second signal path having a second path characteristic signal propagation velocity determined by the physical construction of said second signal path and said second linear sequence of said plural discrete display elements being the reverse ordered sequence of the first linear sequence of said plural discrete display elements;

a first signal path delay element connected to said first terminus of said first signal path, said first signal path delay element having a signal delay time substantially equal to said second path distance divided by said second path characteristic signal propagation velocity;

a first signal path driver operably connected to said first signal path delay element;

a second signal path driver operably connected to said primary terminus of said second signal path;

a variable delay circuit operably connected to said second signal path driver; and a control circuit in electrical communication with said first signal path driver and said variable delay circuit, said control circuit directing said first signal path driver to induce said first signal at a selected one of said plural discrete display elements by signal propagation sequentially along said first linear sequence through a primary subset of the plural discrete display elements at said first path characteristic signal propagation velocity after said signal delay time and directing said variable delay circuit to precipitate said second signal path driver to induce said second signal at said selected one of said plural discrete display elements by signal propagation sequentially along said second linear sequence through a secondary subset of the plural discrete display elements at said second path characteristic signal propagation velocity, said primary subset and said secondary subset including in total, each of the plural discrete display elements and including in common, only the selected one of the plural discrete display elements, said inducement of said second signal being effected after a control circuit directed programmed delay to effect activation of said selected one of said plural discrete display elements by the timed convergence of the first signal and the second signal at the selected one of said plural discrete display elements.

4. The apparatus of claim 1 further comprising:

a plurality of illuminating pixels, one of said plural illuminating pixels being disposed at each of the plural discrete display locations, each of said pixels emitting light from its respective display location upon said timed convergence of said first electrical signal with said second electrical signal at the selected discrete display location.

5. The apparatus of claim 1 further comprising:

an illuminating means uniformly disposed across the display area for emitting light from the selected discrete display location upon said timed convergence of said first electrical signal with said second electrical signal at said selected discrete display location.

6. The apparatus of claim 1 further comprising:

a gas discharge illumination means associated with the display area for emitting light from the selected discrete display location upon said timed convergence of said first electrical signal with said second electrical signal at said selected discrete display location.

7. The apparatus of claim 1 further comprising:

a plurality of liquid crystal display means, one of said plural crystal display means disposed at each of the plural discrete display locations, each liquid crystal display means for changing a visual appearance of its respective display location upon said timed convergence of said first electrical signal with said second electrical signal at the selected discrete display location.

8. The apparatus of claim 1 wherein:

a normal distance between said first continuous propagation path and said second continuous propagation path decreases in at least one of the display locations.

9. The apparatus of claim 1 further comprising:

a display continuation means for enabling the display to produce a continued display signal at said selected discrete display location after said timed convergence of said first electrical signal and said second electrical signal at said selected discrete display location.

* * * * *